US011209229B2

(12) United States Patent
Perez

(10) Patent No.: US 11,209,229 B2
(45) Date of Patent: Dec. 28, 2021

(54) FIREARM AND LINEAR-TO-ROTARY CONVERTER ASSEMBLY

(71) Applicant: Roberto Perez, Wheeling, IL (US)

(72) Inventor: Roberto Perez, Wheeling, IL (US)

( * ) Notice: Subject to any disclaimer, the term of this patent is extended or adjusted under 35 U.S.C. 154(b) by 0 days.

(21) Appl. No.: 17/064,563

(22) Filed: Oct. 6, 2020

(65) Prior Publication Data

US 2021/0102768 A1 Apr. 8, 2021

Related U.S. Application Data

(60) Provisional application No. 62/911,890, filed on Oct. 7, 2019.

(51) Int. Cl.
*F41A 3/78* (2006.01)
*F41A 3/84* (2006.01)

(52) U.S. Cl.
CPC . *F41A 3/78* (2013.01); *F41A 3/84* (2013.01)

(58) Field of Classification Search
CPC ..... F41A 3/78; F41A 3/80; F41A 3/82; F41A 3/84; F41A 3/86; F41A 3/88; F41A 3/90; F41A 3/92; F41A 3/94
USPC ..... 89/198
See application file for complete search history.

(56) References Cited

U.S. PATENT DOCUMENTS 1,356,191 A * 10/1920 Craig ..... F41A 3/78 89/198
2,843,023 A * 7/1958 Debuit ..... F41A 3/66 89/132
3,366,011 A * 1/1968 Sturtevant ..... F41C 23/06 89/198
3,757,636 A * 9/1973 Chiabrandy ..... F41A 3/82 89/169
3,802,313 A * 4/1974 Rocha ..... F41A 3/82 89/130
4,416,186 A * 11/1983 Sullivan ..... F41A 3/26 89/198
8,686,576 B1 * 4/2014 Smith ..... F03G 7/08 290/1 R
9,316,451 B2 * 4/2016 Christenson ..... F41A 3/84
2014/0075798 A1 * 3/2014 Kincel ..... F41A 3/84 42/1.06
2014/0230642 A1 * 8/2014 Reynolds ..... F41A 3/78 89/130
2019/0234698 A1 * 8/2019 Weinland ..... F41A 25/02
2021/0025665 A1 * 1/2021 Kincel ..... F41A 3/84

* cited by examiner

*Primary Examiner* — Joshua E Freeman
(74) *Attorney, Agent, or Firm* — Marshall, Gerstein & Borun LLP

(57) ABSTRACT

A linear-to-rotary converter assembly includes a housing having a first portion, a second portion, and a bore in which a plunger is slidably disposed. The plunger includes a plunger body having threads and a plunger boss extending from the housing. At least one of a one-way bearing or a disk is disposed within the housing bore. A rod is disposed within the housing bore and has a first portion having threads engaging the plunger threads and a second portion extending through the at least one of the one-way bearing or the disk. At least one magnet is disposed within the housing adjacent to the one-way bearing or the disk. Linear movement of the plunger between a firing position and a recoil position rotates the rod and the one-way bearing or the disk in a first direction as the magnet acts on the at least one of the one-way bearing or the disk.

21 Claims, 12 Drawing Sheets

FIREARM AND LINEAR-TO-ROTARY CONVERTER ASSEMBLY

CROSS-REFERENCE TO RELATED APPLICATIONS

This application claims priority to U.S. Provisional Application No. 62/911,890, filed Oct. 7, 2019, the content of which is incorporated by reference herein in its entirety and for all purposes.

FIELD OF THE DISCLOSURE

The present patent relates generally to firearms and, in particular, to firearms and linear-to-rotary converter assemblies that are adapted to reduce recoil force using magnetic resistance.

BACKGROUND

When a handheld firearm is fired, the firearm may recoil and a bolt assembly of the firearm may move rearwardly. To counter a force of the recoil, the bolt assembly may engage a buffer assembly of the firearm. The buffer assembly includes a spring housed within a stock of the firearm.

SUMMARY

In accordance with a first example, a firearm includes a receiver and a buffer assembly coupled to the receiver. The buffer assembly includes a buffer tube, a biasing member, and a buffer. The buffer tube includes a first portion and a second portion. The first portion of the buffer tube is coupled to the receiver. The biasing member is disposed within the buffer tube. The buffer is arranged to be biased by the biasing member and to linearly move within the buffer tube between a firing position and a recoil position. A linear-to-rotary converter assembly includes a housing, a plunger, a rod, a one-way bearing, and a plurality of magnets. The housing includes a first portion, a second portion, and a bore extending between the first and second portions. The first portion of the housing is coupled to the second portion of the buffer tube. The plunger is slidably disposed within the bore of the housing. The plunger includes a plunger body having a plunger bore including threads and a plunger boss extending through an opening of the housing. The plunger boss is arranged to be engaged by the buffer when the buffer is in the recoil position. The rod is disposed within the bore of the housing and has a first portion and a second portion. The first portion of the rod has threads engaging the threads of the plunger bore. The one-way bearing is disposed within the bore of the housing and is adapted to receive the second portion of the rod. The plurality of magnets are disposed adjacent to the housing. Linear movement of the plunger between the firing position and the recoil position rotates the rod and the one-way bearing in a first direction as the plurality of magnets act on the one-way bearing to resist rotation. Linear movement of the plunger between the recoil position and the firing position rotates the rod in a second direction.

In accordance with a second example, a linear-to-rotary converter assembly for use with a firearm is movable between a firing position and a recoil position and includes a housing having a first portion, a second portion, and a bore extending between the first and second portions. A plunger is slidably disposed within the bore of the housing. The plunger includes a plunger body and a plunger boss extending from the housing. The plunger body has threads. A rod is disposed within the bore of the housing and has a first portion and a second portion. The first portion of the rod includes threads engaging the threads of the plunger. At least one of a one-way bearing or a disk is disposed within the bore of the housing. The second portion of the rod extends through the at least one of the one-way bearing or the disk. At least one magnet is disposed within the housing adjacent to the at least one of the one-way bearing or the disk. Linear movement of the plunger between the firing position and the recoil position rotates the rod and the at least one of the one-way bearing or the disk in a first direction as the at least one magnet acts on the at least one of the one-way bearing or the disk. Linear movement of the plunger between the recoil position and the firing position rotates the rod in a second direction.

In accordance with a third example, a firearm includes a receiver having a bolt assembly, a first portion, and a second portion. The bolt assembly is arranged to move between a firing position and a recoil position. A barrel is coupled to the first portion of the receiver. A buffer assembly includes a buffer tube having a first portion and a second portion. The first portion of the buffer tube is coupled to the second portion of the receiver. A buffer is arranged to engage the bolt assembly. The buffer is further arranged to linearly move within the buffer tube between the firing position and the recoil position. The firearm includes means for converting the linear movement of the buffer to rotary motion.

In accordance with a fourth example, a linear-to-rotary converter assembly is movable between a first position and a second position and includes a housing having a first portion, a second portion, and a bore extending between the first and second portions. The linear-to-rotary converter assembly includes a plunger slidably disposed within the bore of the housing. The plunger includes a plunger body and a plunger boss extending from the housing. The plunger body has threads. The linear-to-rotary converter assembly includes a rod disposed within the bore of the housing and has a first portion and a second portion. The first portion of the rod includes threads engaging the threads of the plunger. The linear-to-rotary converter assembly includes at least one of a one-way bearing or a disk disposed within the bore of the housing. The second portion of the rod extends through the at least one of the one-way bearing or the disk. The linear-to-rotary converter assembly includes at least one magnet disposed within the housing adjacent to the at least one of the one-way bearing or the disk. Linear movement of the plunger between the first position and the second position rotates the rod and the at least one of the one-way bearing or the disk in a first direction as the at least one magnet acts on the at least one of the one-way bearing or the disk. Linear movement of the plunger between the second position and the first position rotates the rod in a second direction.

In accordance with a fifth example, a firearm includes a receiver having a bolt assembly, a first portion, and a second portion. The bolt assembly is arranged to move between a firing position and a recoil position. The firearm arm includes a barrel coupled to the first portion of the receiver and means for converting linear movement of the bolt assembly to rotary motion.

In further accordance with the foregoing first, second, third, fourth, and/or fifth examples, an apparatus may further include any one or more of the following:

In an example, the linear movement of the plunger between the recoil position and the firing position may rotate the rod in the second direction without the plurality of magnets acting on the rod to resist rotation.

In another example, the housing may further include a key extending into the bore of the housing and the plunger body may include a key seat receiving the key.

In another example, the housing may include a divider having a bore. The divider may separate the bore of the housing into a first sub-bore and a second sub-bore. The rod may extend through the bore of the divider. The first portion of the rod may extend into the first sub-bore. The second portion of the rod may extend into the second sub-bore.

In another example, the first portion of the rod may have a larger diameter than the second portion of the rod.

In another example, the second portion of the rod may include an external groove. The firearm and/or the linear-to-converter assembly may further include a retaining clip disposed in the second sub-bore, received within the external groove of the second portion of the rod, and arranged to abut the divider.

In another example, the first portion of the rod may include a bore. The firearm and/or the linear-to-converter assembly may further include a return spring disposed within the bore of the first portion of the rod and arranged to bias the plunger toward the firing position.

In another example, the second portion of the rod may include a bore and the housing may include a guide rod that extends through the bore of the second portion of the rod.

In another example, the plunger may include a plunger bore having the threads, and the threads of the first portion of the rod may engage the threads of the plunger bore.

In another example, the plunger may include external threads and the first portion of the rod may include a bore having internal threads. The internal threads of the rod may engage the external threads of the plunger.

In another example, the disk may be coupled to the one-way bearing and may rotate with the one-way bearing in the first direction.

In another example, the at least one magnet may be fixed relative to the housing.

In another example, the at least one magnet may be fixed to the housing and may include a first plurality of magnets. The linear-to-rotary converter assembly may further include at least one second magnet. The at least one second magnet may be fixed relative to the one-way bearing. The first plurality of magnets may act on the at least one second magnet when the rod and the one-way bearing rotate in the first direction.

In another example, the disk may be fixed relative to the housing, and the at least one magnet may be fixed relative to the one-way bearing and may rotate with the one-way bearing in the first direction.

In another example, the linear-to-rotary assembly may further include a return spring. The return spring may be adapted to urge the plunger toward the firing position.

In another example, the first portion of the rod may include a bore, and the return spring may be disposed within the bore of the first portion of the rod and may be adapted to bias the plunger toward the firing position.

In another example, the return spring may be one of an extension spring coupled to and between the plunger and the housing or a torsion spring disposed around the rod and having a first portion and a second portion. The first portion of the torsion spring may be coupled to the housing. The second portion of the torsion spring may be coupled to the rod.

In another example, the disk may be disposed within the bore of the housing. The second portion of the rod may extend through the bore of the disk, and the second portion of the rod may further include teeth. A follower may be coupled to the disk and may extend into the bore of the disk. The follower may be adapted to engage the teeth to form a ratchet.

In another example, the linear-to-rotary converter assembly may be for use with a buffer assembly of a firearm and the first position may be a firing position and the second position may be a recoil position.

In another example, the linear-to-rotary assembly may include a return spring. The return spring may be adapted to urge the plunger toward the first position.

In another example, the first portion of the rod may include a bore. The return spring may be disposed within the bore of the first portion of the rod and may be adapted to bias the plunger toward the first position.

In another example, means for converting the linear movement of the buffer to rotary motion includes a linear-to-rotary converter assembly and a housing coupled to the second portion of the buffer tube and has a bore including an opening. A plunger may be linearly-movably coupled within the bore of the housing. The plunger may include a plunger body and a plunger boss. The plunger may include threads. The plunger boss may extend through the opening of the housing and may be arranged to be engaged by the buffer. A rod may be rotatably coupled within the bore of the housing. The rod includes a first portion and a second portion. The first portion of the rod may include threads engaging the threads of the plunger. The second portion of the rod may include teeth. A disk may define a bore and may be disposed in the housing. The second portion of the rod may extend through the bore of the disk. The teeth of the second portion of the rod may be disposed within the bore of the disk. A follower may be coupled to the disk and may extend into the bore of the disk. The follower may be adapted to engage the teeth to form a ratchet. A magnet may be disposed adjacent the housing. Linear movement of the plunger between the firing position and the recoil position may rotate the rod and the disk as the magnet acts on the disk.

In another example, the means for converting the linear movement of the buffer to rotary motion may include a linear-to-rotary converter assembly and may include a housing coupled to the second portion of the buffer tube and has a bore including an opening. A plunger may be movably coupled within the bore of the housing. The plunger may include a plunger body and a plunger boss. The plunger body may include threads. The plunger boss may extend through the opening of the housing and may be arranged to be engaged by the buffer. A first rod may be rotatably coupled within the bore of the housing. The first rod has a first portion and a second portion. The first portion of the first rod may include threads engaging the threads of the plunger bore. A second rod may include a flange and a lateral protrusion and may define a bore. The second portion of the first rod may be disposed within the bore of the second rod. A biasing member may surround the first rod and the second rod. The biasing member has a first portion and a second portion. The first portion of the biasing member may be coupled to the first rod. The second portion of the biasing member may be selectively coupled to the lateral protrusion of the second rod. A magnet may be disposed adjacent the housing. Linear movement of the plunger between the firing position and the recoil position may rotate the first rod and the second rod via the selective coupling between the second portion of the biasing member and the lateral protrusion of the second rod as the magnet acts on the flange.

In another example, the means for converting the linear movement of the buffer to rotary motion may include a linear-to-rotary converter assembly.

In another example, the firearm further includes a buffer assembly including a buffer tube having a first portion and a second portion. The first portion of the buffer tube may be coupled to the second portion of the receiver. The buffer assembly includes a buffer that may be arranged to engage the bolt assembly. The buffer may be further arranged to linearly move within the buffer tube between the firing position and the recoil position. The buffer assembly includes the means for converting the linear movement of the bolt assembly to rotary motion.

In another example, the means for converting the linear movement of the bolt assembly to rotary motion includes a linear-to-rotary converter assembly. The linear-to-rotary converter assembly includes a housing that may be coupled to the second portion of the buffer tube and may have a bore including an opening. The linear-to-rotary converter assembly may include a plunger linearly-movably coupled within the bore of the housing. The plunger may include a plunger body and a plunger boss. The plunger may include threads. The plunger boss may extend through the opening of the housing and may be arranged to be engaged by the buffer. The linear-to-rotary converter assembly may include a rod rotatably coupled within the bore of the housing. The rod may have a first portion and a second portion. The first portion of the rod may include threads engaging the threads of the plunger. The second portion of the rod may include teeth. The linear-to-rotary converter assembly may include a disk defining a bore and may be disposed in the housing. The second portion of the rod may extend through the bore of the disk. The teeth of the second portion of the rod may be disposed within the bore of the disk. A follower may be coupled to the disk and may extend into the bore of the disk. The follower may be adapted to engage the teeth to form a ratchet. The linear-to-rotary converter assembly may include a magnet disposed adjacent the housing. Linear movement of the plunger between the firing position and the recoil position may rotate the rod and the disk as the magnet acts on the disk.

In another example, the means for converting the linear movement of the bolt assembly to rotary motion may include a linear-to-rotary converter assembly. The linear-to-rotary converter assembly may include a housing coupled to the second portion of the buffer tube and may have a bore including an opening. The linear-to-rotary converter assembly may include a plunger movably coupled within the bore of the housing. The plunger may include a plunger body and a plunger boss. The plunger body may include threads. The plunger boss may extend through the opening of the housing and may be arranged to be engaged by the buffer. The linear-to-rotary converter assembly may include a first rod rotatably coupled within the bore of the housing. The first rod has a first portion and a second portion. The first portion of the first rod may include threads engaging the threads of the plunger bore. The linear-to-rotary converter assembly may include a second rod having a flange and a lateral protrusion and defining a bore. The second portion of the first rod may be disposed within the bore of the second rod. The linear-to-rotary converter assembly may include a biasing member surrounding the first rod and the second rod. The biasing member has a first portion and a second portion. The first portion of the biasing member may be coupled to the first rod. The second portion of the biasing member may be selectively coupled to the lateral protrusion of the second rod. The linear-to-rotary converter assembly may include a magnet disposed adjacent the housing. Linear movement of the plunger between the firing position and the recoil position may rotate the first rod and the second rod via the selective coupling between the second portion of the biasing member and the lateral protrusion of the second rod as the magnet acts on the flange.

In another example, the means for converting the linear movement of the bolt assembly to rotary motion includes a linear-to-rotary converter assembly.

In another example, the plunger bore having threads includes a ball nut and the rod having threads includes a ball screw.

In another example, the plunger body having threads includes a ball nut and the rod comprising threads includes a ball screw.

DETAILED DESCRIPTION

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

Figure 1:
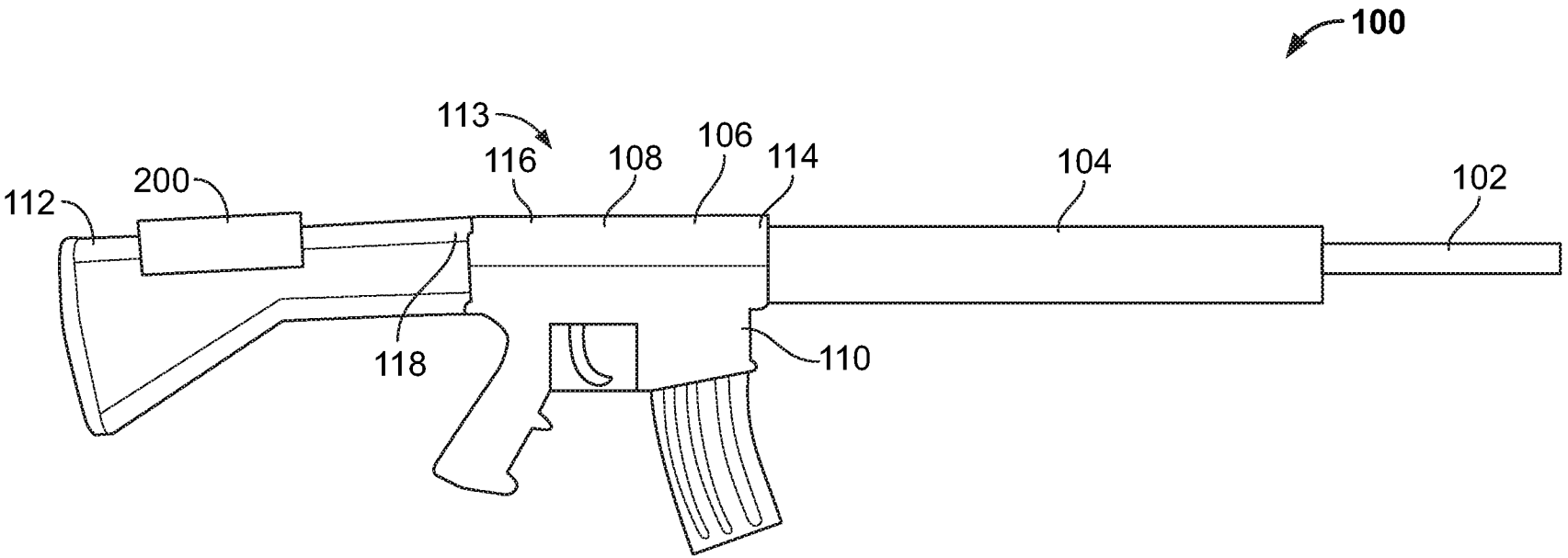
FIG. 1 illustrates a firearm assembled in accordance with a first example of the present invention including a linear-to-rotary converter assembly.

Referring now to the drawings, FIG. 1 illustrates a firearm 100 assembled in accordance with a first example of the present invention. The firearm 100 may include any semi-automatic or automatic firearm such as, for example, a rifle, a semi-automatic shotgun, a rifle-caliber handgun, etc. In accordance with the disclosed example, the firearm 100 includes a barrel 102, a handguard 104, a receiver 106 including an upper receiver 108 and a lower receiver 110, and a stock 112. A bolt assembly 113 is carried by the receiver 106. The receiver 106 includes a first portion 114 and a second portion 116. The barrel 102 and the handguard 104 are coupled to the first portion 114 of the receiver 106 and the stock 112 is coupled to the second portion 116 of the receiver 106.

In the example shown, the stock 112 includes a buffer assembly 118 and a linear-to-rotary converter assembly 200. The buffer assembly 118 is coupled to the second portion 116 of the receiver 106 and the linear-to-rotary converter assembly 200 is coupled to the buffer assembly 118. The linear-to-rotary converter assembly 200 may be adapted to convert linear motion of, for example, the bolt assembly 113 carried by the upper receiver 108 to rotary motion. The linear-to-rotary converter assembly 200 may be adapted to deter this rotary motion to reduce the recoil force of the firearm 100. In an example, the rotary motion of the linear-to-rotary converter assembly 200 as disclosed below may mirror the rotary motion of a projectile (e.g., a bullet) exiting the barrel 102 of the firearm 100. Thus, the linear-to-rotary converter assembly 200 may be adapted to counter the rotary force caused by the projectile and the resulting tendency of the barrel 102 to shift, for example, up and to the right, after firing.

Figure 2:
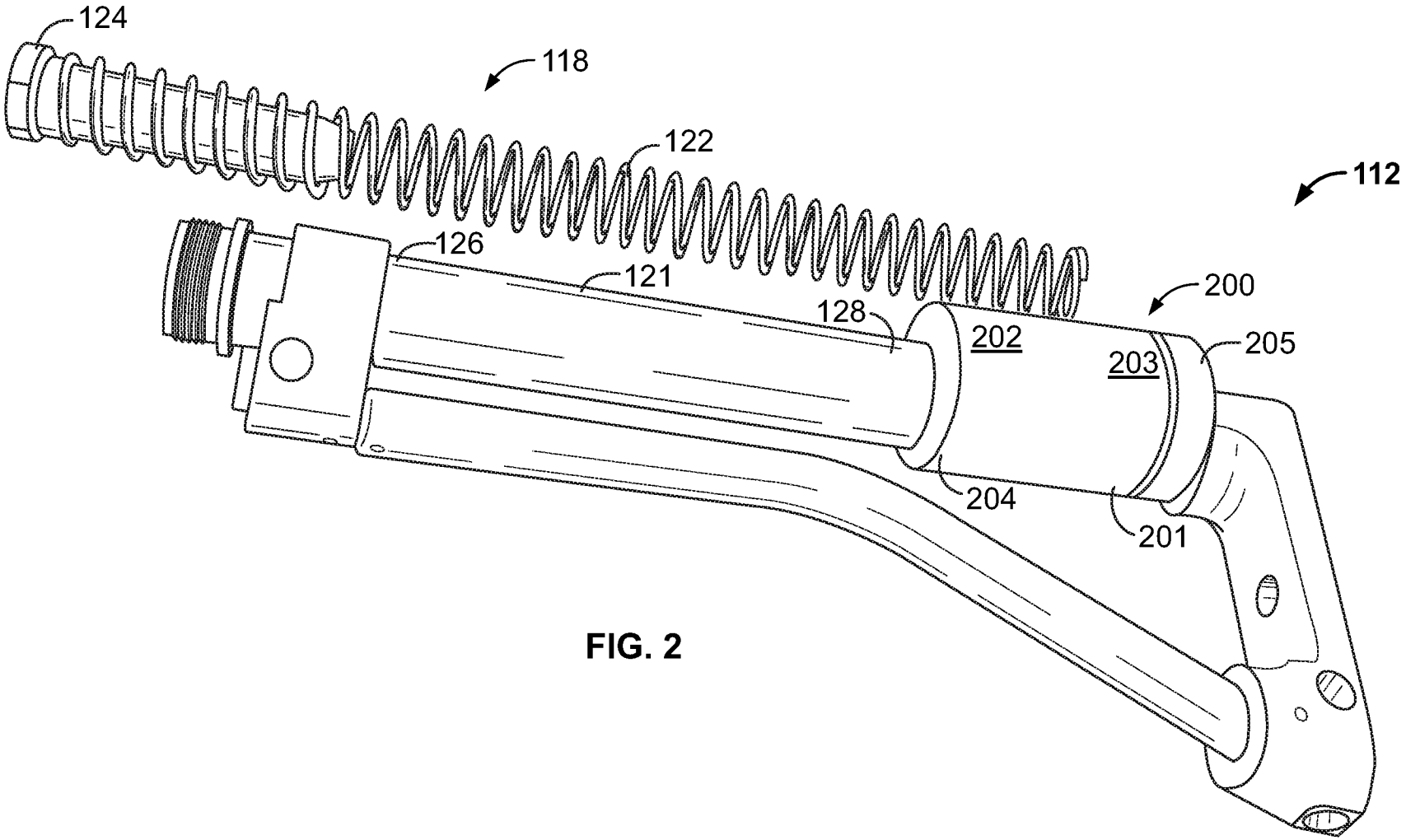
FIG. 2 illustrates an isometric partially expanded view of a stock of the firearm of FIG. 1 including the buffer assembly and the linear-to-rotary converter assembly of FIG. 1.

FIG. 2 illustrates an isometric partially expanded view of the stock 112 including the buffer assembly 118 and the linear-to-rotary converter assembly 200. In the example shown, the buffer assembly 118 includes a buffer tube 121, a biasing member 122, and a buffer 124. The buffer tube 121 includes a first portion 126 and a second portion 128. The first portion 126 of the buffer tube 121 is coupled to the receiver 106. The biasing member 122 and the buffer 124 are adapted to be disposed within the buffer tube 121 with the buffer 124 being partially received by the biasing member 122. So configured, the buffer 124 of the firearm 100 of FIG. 1 is arranged to be biased by the biasing member 122 and to linearly move within the buffer tube 121 between a firing position and a recoil position.

The linear-to-rotary converter assembly 200 includes a housing 201 having a first portion 202 and a second portion 203, a front end cap 204, and a rear end cap 205. The front end cap 204 is coupled to the first portion 202 of the housing 201 and to the second portion 128 of the buffer tube 121. In an example, the front end cap 204 includes a spring seat (not shown) that receives the biasing member 122. As an alternative, the front end cap 204 may be formed with the buffer tube 121. Thus, in that example, the front end cap 204 of the buffer tube 121 may be coupled to the first portion 202 of the housing 201.

The rear end cap 205 is coupled to the second portion 203 of the housing 201. In some examples, the front end cap 204 and the rear end cap 205 may be considered part of the housing 201. In the example shown, the housing 201, the front end cap 204, and the rear end cap 205 have a circular cross-section and are made of plastic. However, the housing 201, the front end cap 204, and the rear end cap 205 may alternatively take the form of various other shapes and/or comprise various other materials and still fall within the scope of the present disclosure.

Figure 3:
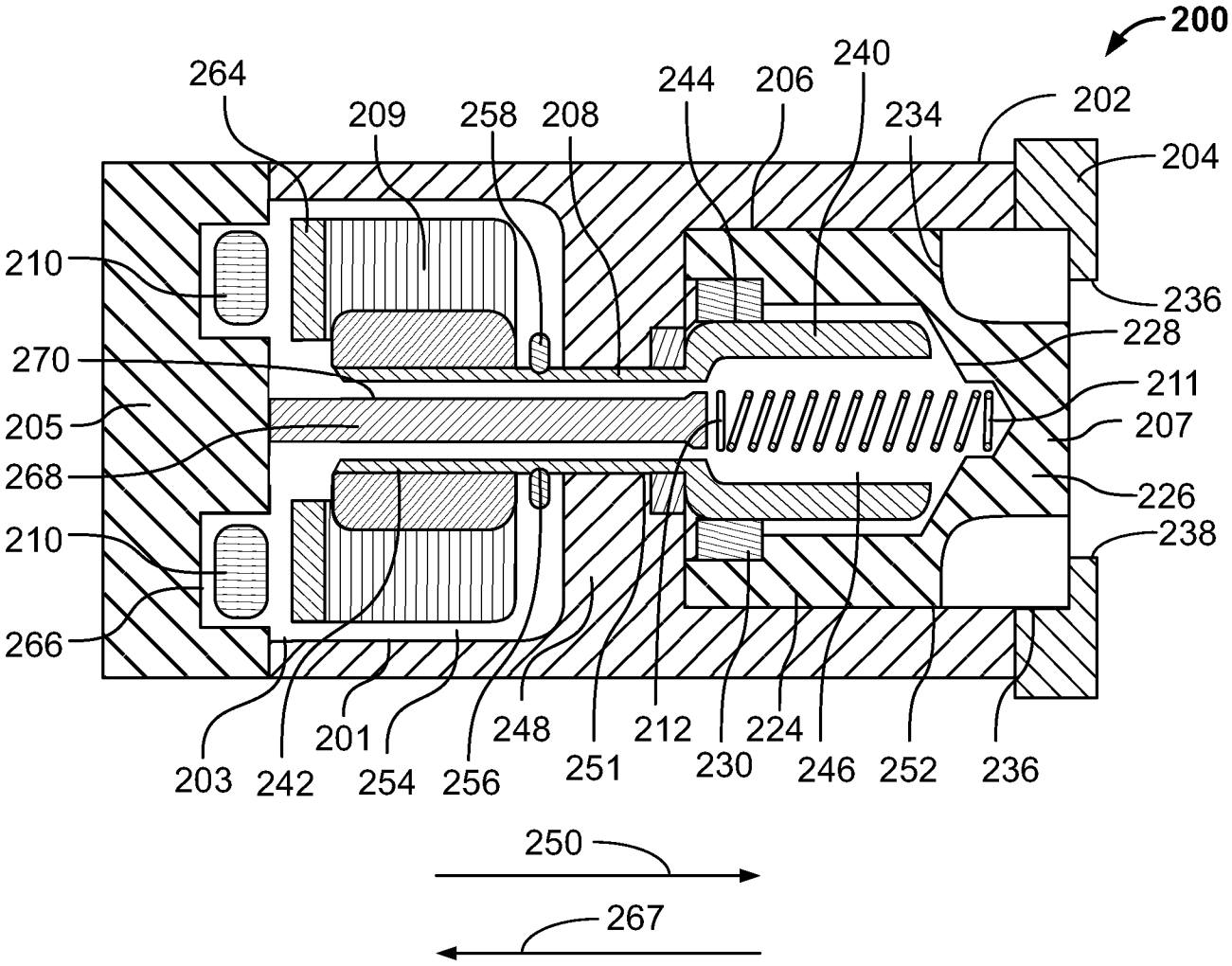
FIG. 3 illustrates a cross-sectional view of the linear-to-rotary converter assembly of FIG. 1 in a recoil position.

Referring now to FIG. 3, a cross-sectional view of the linear-to-rotary converter assembly 200 is illustrated. The linear-to-rotary converter assembly 200 includes the housing 201 having a bore 206, a plunger 207, a rod 208, a one-way bearing 209, and a plurality of magnets 210. The linear-to-rotary converter assembly 200 also includes a return spring 211 and a spring-end cover 212. Generally, the plunger 207 is slidably disposed within the housing 201 and is adapted to interact with and rotate the rod 208 and the one-way bearing 209. When the rod 208 and the one-way bearing 209 rotate, the plurality of magnets 210 act on the one-way bearing 209 to slow rotation of the rod 208, all of which is explained more below.

In this example, the plunger 207 includes a plunger body 224 and a plunger boss 226. The plunger body 224 includes a plunger bore 228 having threads 230. The plunger boss 226 extends through an opening 232 of the housing 201.

In addition, the front end cap 214 is coupled to the first portion 202 of the housing 201. A step 234 is formed between the plunger body 224 and the plunger boss 226. The step 234 is adapted to engage a flange 236 of the front end cap 214. In the example shown, the flange 236 defines an opening 238 through which the plunger boss 226 extends in, for example, the firing position. The plunger boss 226 is arranged to be engaged by the buffer 124 and/or by the buffer assembly 118 when the buffer 124 is in the recoil position.

In addition, the rod 208 is disposed within the bore 206 of the housing 201 and includes a first rod portion 240 and a second rod portion 242. The first rod portion 240 of the rod 208 may have a larger diameter than the second rod portion 242. In the example shown, the first rod portion 240 includes threads 244 and a bore 246. In some examples, the threads 244 of the rod 208 are external threads that threadably engage the threads 230 of the plunger 207, which are internal threads. The threads 230, 244 may have similar or the same pitch as the rifling of the bore of the barrel 102. As a result, rotary movement of the rod 208 may correspond to rotation of the projectile exiting the barrel 102 via the rifling. Thus, based on the interaction between the corresponding threads 230, 244, linear movement of the plunger 207 causes the rod 208 to rotate. It will be appreciated that other alternative engaging mechanisms may be used and still fall within the scope of the present disclosure. For example, a ball screw assembly may be used, where the first rod portion 240 includes a ball screw and the plunger 270 includes a corresponding ball nut.

The return spring 211 is disposed within the bore 246 of the first rod portion 240 of the rod 208 and is arranged to bias the plunger 207 toward the firing position and in a direction generally indicated by arrow 250.

In the example shown, the housing 201 includes a divider 248 having a bore 251. The divider 248 separates the bore 206 of the housing 201 into a first sub-bore 252 and a second sub-bore 254. The first rod portion 240 of the rod 208 extends into the first sub-bore 252 and the second rod portion 242 of the rod 208 extends into the second sub-bore 254.

The rod 208 defines an external groove 256. A retaining clip 258 is received within the external groove 256. The retaining clip 258 may be a C-clip. The retaining clip 258 is disposed in the second sub-bore 254 and is arranged to abut the divider 248. An interaction between the first rod portion 240 of the rod 208 having the larger diameter and the divider 248 and between the retaining clip 258 and the divider 248 allows the rod 208 to rotate within the housing 201 but secures the longitudinal position of the rod 208 within the housing 201. Alternatively, the second rod portion 242 may have a larger diameter than the first rod portion 240 and the external groove 256 receiving the retaining clip 258 may be defined by the first rod portion 240.

The one-way bearing 209 is disposed within the bore 206 of the housing 201 and receives the second rod portion 242 of the rod 208. In an example, the one-way bearing 209 is a needle bearing or a sprag bearing. However, any type of one-way bearing or clutch can be used to implement the linear-to-rotary converter assembly 200 of FIG. 2 or any of the examples disclosed herein and still fall within the scope of the present disclosure The rod 208 extends through the one-way bearing 209 and interacts with/engages the one-way bearing 209 in a manner that allows rotation of the rod 208 in a first direction to also rotate the one-way bearing 209 in the first direction. Rotation of the rod 208 in the first direction is associated with the plunger 207 moving from the firing position to the recoil position. Rotation of the rod 208 in the second direction is associated with the plunger 207 moving from the recoil position to the firing position.

As further depicted in FIG. 3, a disk 264 is coupled to the one-way bearing 209 and faces a rear of the linear-to-rotary converter assembly 200. The disk 264 may be made of ferromagnetic material (e.g., metal). The disk 264 may be arranged to rotate with the one-way bearing 209 in a manner that allows the plurality of magnets 210 to act on the disk 264 and deter or otherwise slow and/or reduce rotation of the rod 208 as further detailed below. In an example, the dimensions of the disk 264 may be modified to change an amount of attraction between the disk 264 and the plurality of magnets 210. For example, a thickness of the disk 264 may be increased and/or made stronger, or more magnets may be provided to increase the attraction between the disk 264 and the plurality of magnets 210.

The plurality of magnets 210 are disposed adjacent to the housing 201. Specifically, the plurality of magnets 210 are carried by receptacles 266 of the rear end cap 216 coupled to the second portion 220 of the housing 201. Adhesive or other means may be used to secure the plurality of magnets 210 within the corresponding receptacles 266. The plurality of magnets 210 may be positioned to act on the disk 264 and may be outwardly spaced from a longitudinal axis of the rod 205 to multiply or otherwise increase an amount of resistance and torque applied by the plurality of magnets 210 when the disk 264 is rotated. Thus, the plurality of magnets 210 may be positioned to increase a rotational-resistive force applied to the rod 205, via the disk 264. In one example, the plurality of magnets 210 may include two magnets. In other examples, the plurality of magnets 210 may include more than two magnets and still fall within the scope of the present disclosure. In yet other examples, the plurality of magnets 210 may be replaced by a single magnet and still fall within the scope of the present disclosure.

In operation, linear movement of the plunger 207 between the firing position and the recoil position in a direction generally indicated by arrow 267 rotates the rod 208, the one-way bearing 209, and the associated disk 264 in a first direction. During this rotation, the plurality of magnets 210 act on the one-way bearing 209 and the disk 264 to resist rotation of the rod 208. As the plunger 207 moves between the recoil position and the firing position, the rod 208 rotates in a second direction. In some examples, because the one-way bearing 209 only rotates in one direction, when the rod 208 rotates in the second direction, the one-way bearing 209 is adapted not to rotate with the rod 208. Thus, when the rod 208 rotates in the second direction, the plurality of magnets 210 acting on the one-way bearing 209 and/or the associated disk 264 may not resist or may otherwise allow the rod 208 to rotate with less resistance.

In the example shown, the housing 201 and, specifically, the rear end cap 216 includes a guide rod 268. The guide rod 268 is arranged to extend toward a muzzle end of the firearm 100. The second rod portion 242 of the rod 208 has a bore 270. The bore 270 of the rod 208 is adapted to receive the guide rod 268 to allow the rod 208 to rotate around and relative to the guide rod 268.

The spring-end cover 212 is coupled to the return spring 211 and is adapted to engage the guide rod 268. An interaction between the spring-end cover 212 and the guide rod 268 may deter the return spring 211 from jamming within the plunger bore 228, for example. While the example of FIG. 3 includes the guide rod 268 received within the bore 270 of the rod 208, the guide rod 268 and the bore 270 may alternatively be excluded and still fall within the scope of the present disclosure.

Figure 4:
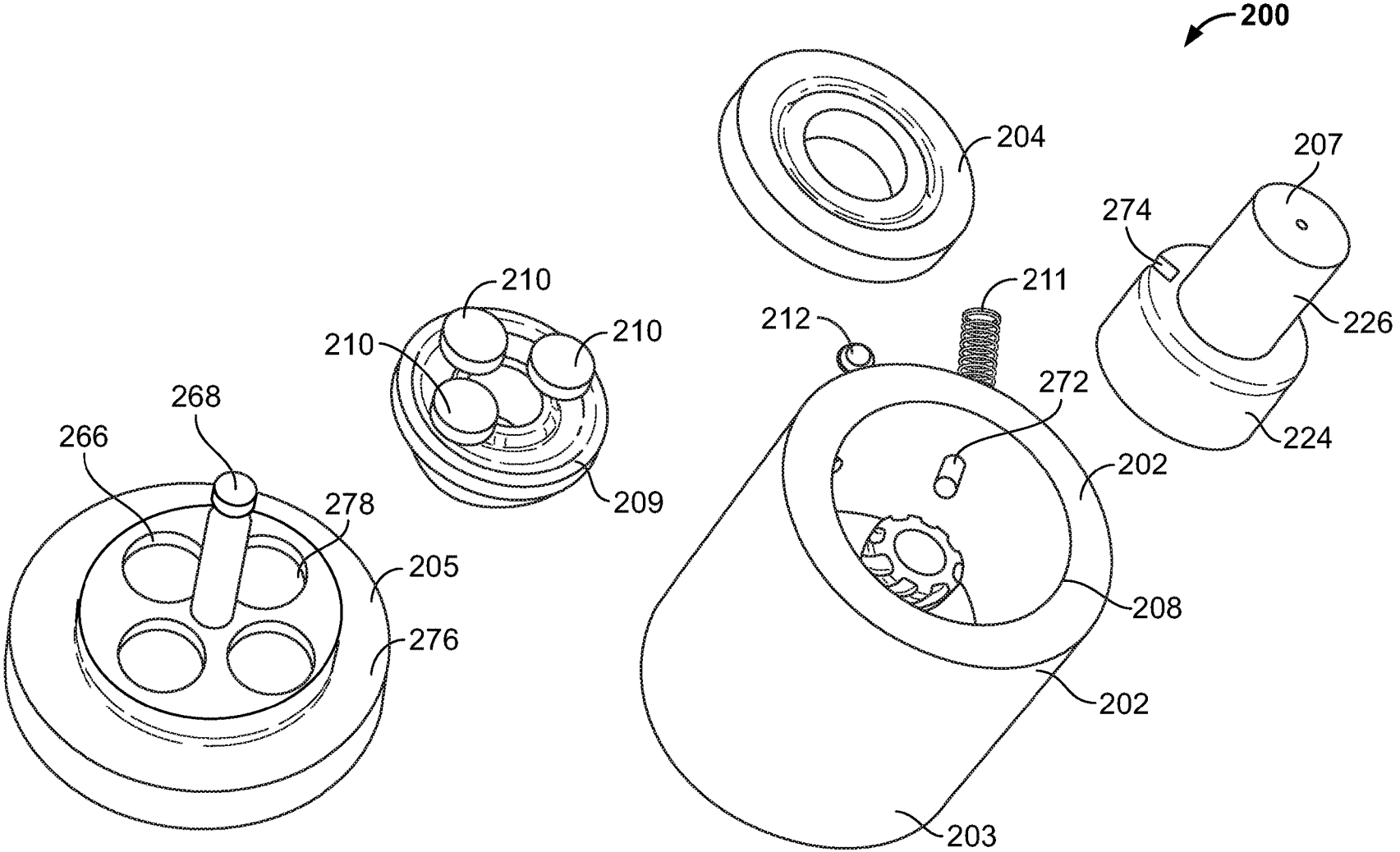
FIG. 4 illustrates a partially expanded view of the linear-to-rotary converter assembly of FIG. 1.

Referring to FIG. 4, the housing 201 has a key 272 that extends into the bore 206 of the housing 201. The plunger body 224 defines a key seat 274 adapted to receive the key 272. An interaction between the key 272 and the key seat 274 causes the plunger 207 to linearly move within the housing 201 and deters rotation of the plunger 207.

In the example shown, the rear end cap 205 includes a flange 276 and a boss 278. The flange 276 is adapted to engage the second portion 203 of the housing 201. The boss 278 defines the receptacles 266 and is adapted to be received within the second sub-bore 254 of the housing 201. In an example, the front end cap 204 is adapted to surround the first portion 202 of the housing 201 when the front end cap 204 is coupled to the housing 201.

Figure 5:
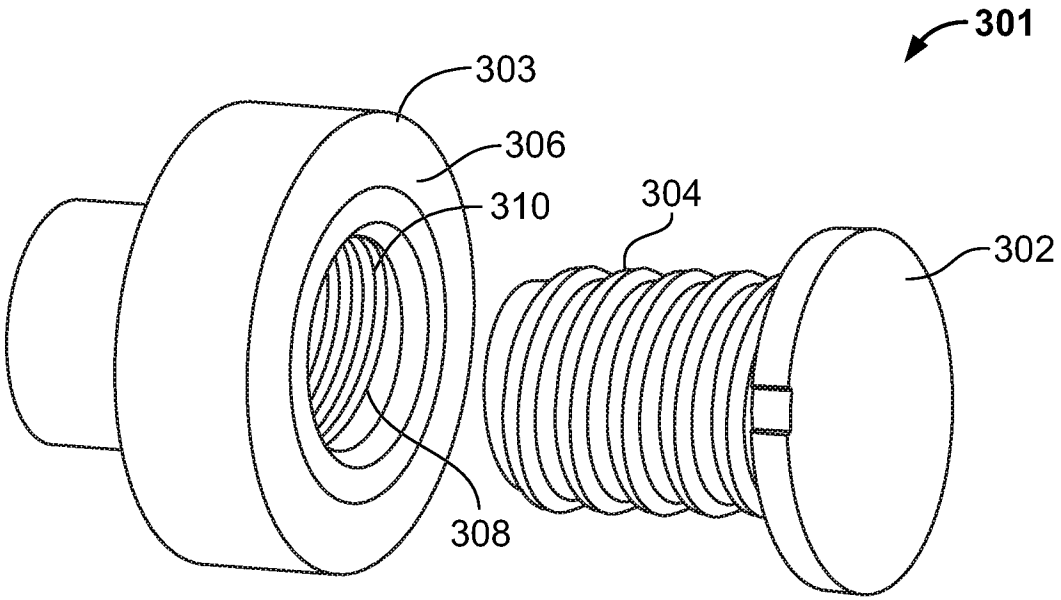
FIG. 5 illustrates a portion of a linear-to-rotary converter assembly assembled in accordance with a second example of the invention.

Referring now to FIG. 5, a portion 301 of a linear-to-rotary converter assembly assembled in accordance with a second example of the invention is shown. The portion 301 of the linear-to-rotary converter assembly includes a plunger 302 and a rod 303. The plunger 302 and the rod 303 are similar to the rod 208 and the plunger 207 of the linear-to-rotary converter assembly 200 of FIGS. 2, 3 and 4 in that the rotation of the rod 303 may be slowed by the plurality of magnets 210. In contrast, the plunger 302 has external threads 304 and the rod 303 includes a portion 306 defining a rod bore 308 having internal threads 310. The plunger 302 is adapted to be received within the rod bore 308 of the rod 303. The internal threads 310 of the rod 303 are adapted to engage the external threads 304 of the plunger 302. Providing the rod 303 with the rod bore 308 and the internal thread 310 may allow for the rod 303 to have a larger diameter. With a larger diameter, the rod 303 of FIG. 5 may more easily be coupled to a one-way bearing having a larger dimeter and, thus, stronger, allowing such a bearing to have a lesser tendency to slip when exposed to a threshold amount of torque.

In operation, like the linear-to-rotary converter assembly 200 described above, the plunger 302 is adapted to be engaged by the buffer 124 causing the plunger 302 to linearly move while the threads 304, 310 interact with and rotate the rod 303.

Figure 6:
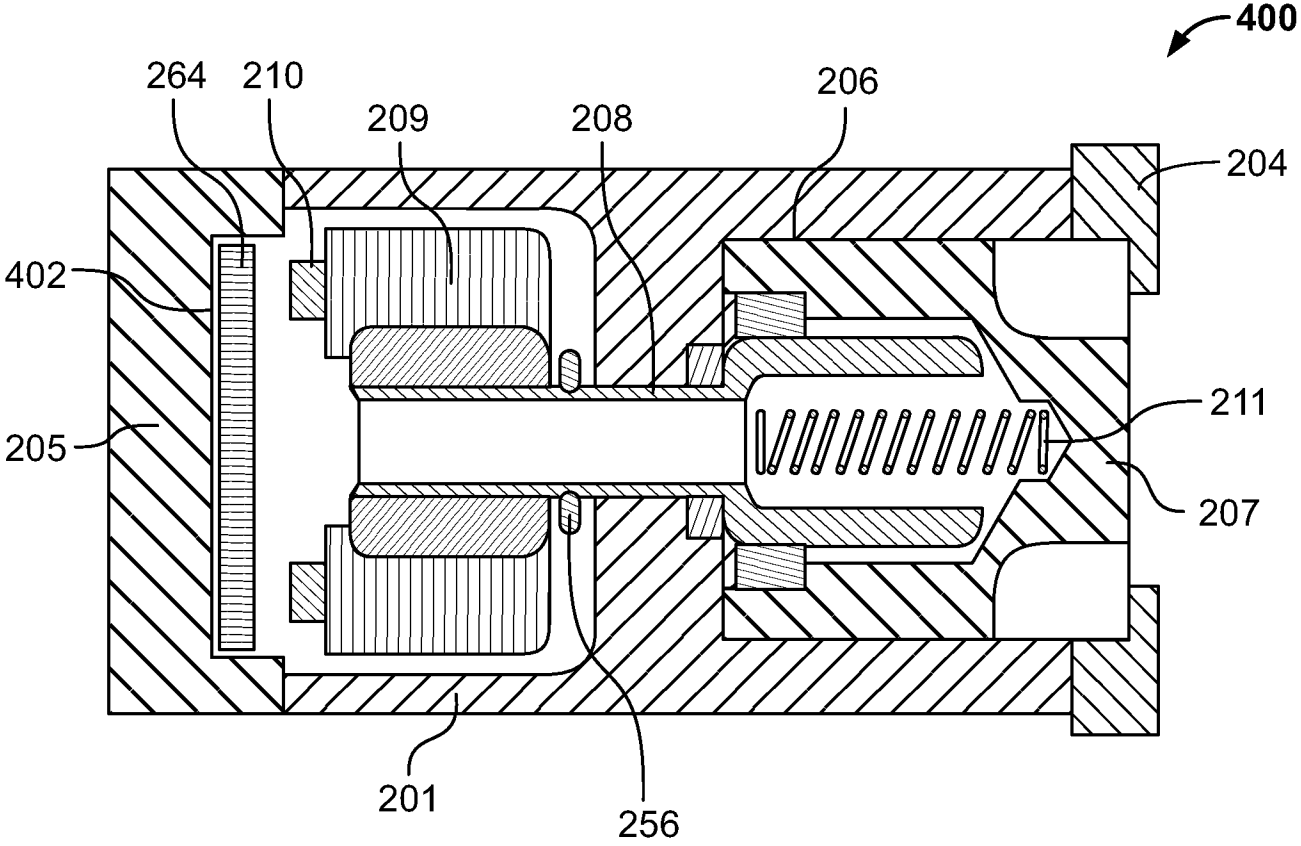
FIG. 6 illustrates a cross-sectional view of a linear-to-rotary converter assembly assembled in accordance with a third example of the invention.

FIG. 6 illustrates a cross-sectional view of a linear-to-rotary converter assembly 400 assembled in accordance with a third example of the invention. The linear-to-rotary converter assembly 400 is similar to the linear-to-rotary converter assembly 200 of FIG. 2. Elements of the linear-to-rotary converter assembly 400 which are the same or similar to the linear-to-rotary converter assembly 200 are designated by the same reference numerals. A description of many of these elements is abbreviated or eliminated in the interest of brevity. In contrast to the linear-to-rotary converter assembly 200, the linear-to-rotary converter assembly 400 includes the disk 264 fixed relative to the housing 201 and the plurality of magnets 210 are fixed relative to the one-way bearing 209. In operation, the plurality of magnets 210 rotate with the one-way bearing 209 when, for example, the rod 208 rotates in the first direction between the firing position and the recoil position. In the example shown, the rear end cap 216 includes a receptacle 402 that is adapted to receive the disk 264. Coupling the disk 264 to the housing 201 as opposed to coupling the disk 264 to the one-way bearing 209 as described above may reduce an amount of space consumed by the disk 264 because the disk 264 may be recessed within the rear end cap 216. As a result, the length of the linear-to-rotary converter assembly 400 may be reduced.

Figure 7:
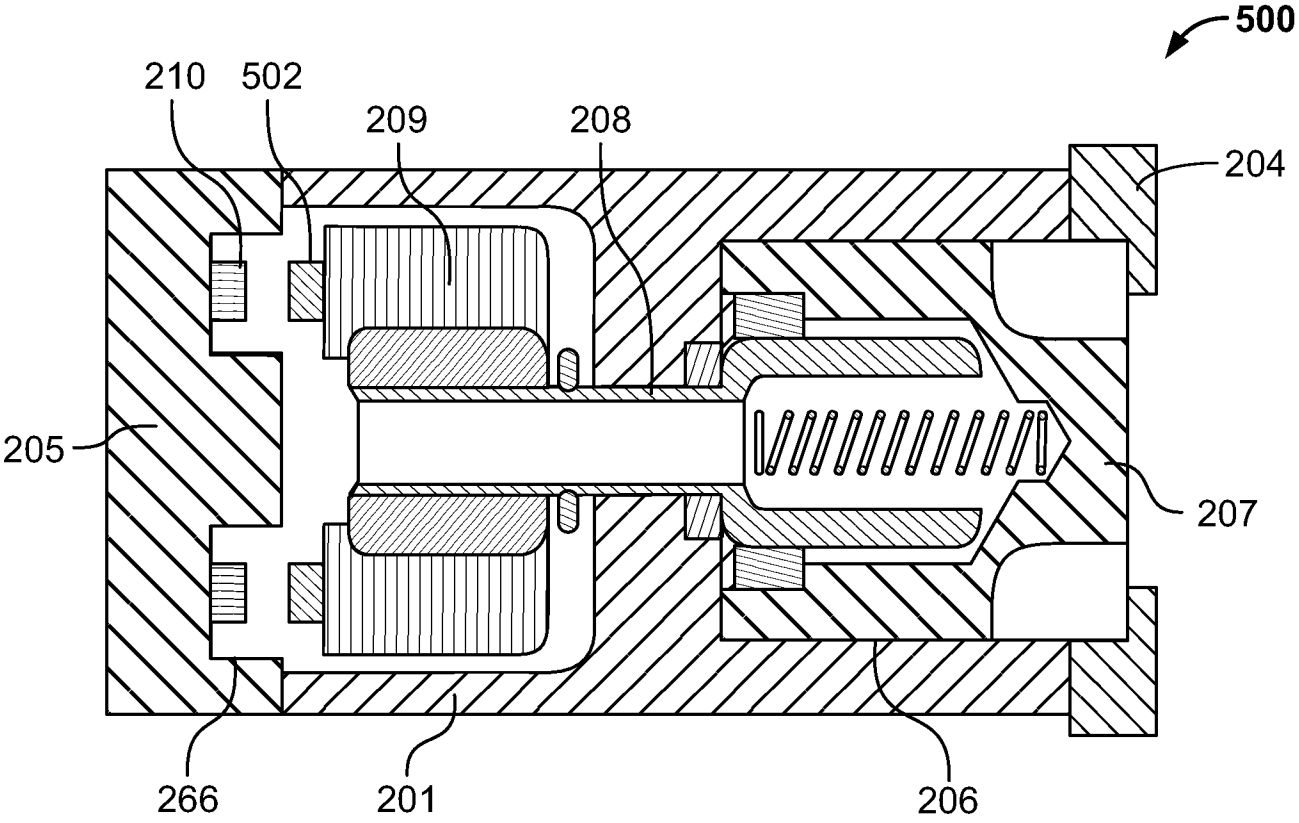
FIG. 7 illustrates a cross-sectional view of a linear-to-rotary converter assembly assembled in accordance with a fourth example of the invention.

FIG. 7 illustrates a cross-sectional view of a linear-to-rotary converter assembly 500 assembled in accordance with a fourth example of the invention. The linear-to-rotary converter assembly 500 is similar to the linear-to-rotary converter assembly 200 of FIG. 2. For example, like the linear-to-rotary converter assembly 200 of FIG. 2, the linear-to-rotary converter assembly 500 also includes the housing 201 having the bore 206 that slidably receives the plunger 207 and the rod 208 that is rotationally coupled within the housing 201 and that threadably engages the plunger 207. The linear-to-rotary converter assembly 500 also includes the one-way bearing 209 through which the rod 208 extends. However, in contrast, the linear-to-rotary converter assembly 500 includes a second plurality of magnets 502. Thus, in this example, the plurality of magnets 210 are a first plurality of magnets 210 and the disk 264 is not included. The second plurality of magnets 502 are fixed relative to the one-way bearing 209 and are arranged to be attracted to the first plurality of magnets 210 fixed relative to the housing 201 (e.g., positive poles facing negative poles). So configured, the plurality of magnets 210 are adapted to act on at least one magnet of the second plurality of magnets 502 when the one-way bearing 209 is rotated in the first direction, via the rod 208, between the firing position toward the recoil position. Providing the linear-to-rotary converter assembly 500 with the first and second plurality of magnets 210, 502, respectively, may increase the attractive force as compared to if the disk 264 were provided. As a result, a greater rotationally-resistive force may be generated between the first and second plurality of magnets 210, 502 that deters the rotation of the one-way bearing 209 and, thus, the rod 208. Alternatively, the second plurality of magnets 502 may be replaced by a single magnet and still fall within the scope of this disclosure.

Figure 8:
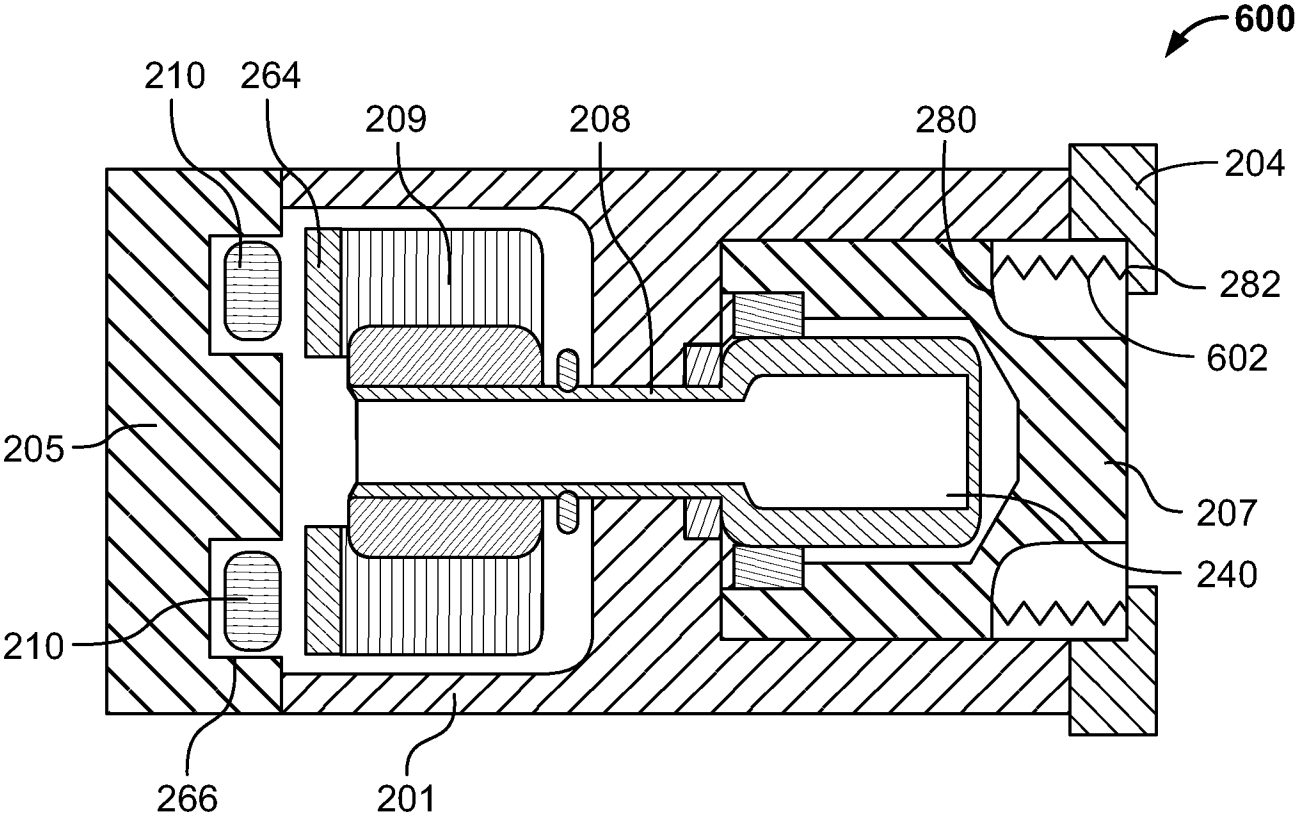
FIG. 8 illustrates a cross-sectional view of a linear-to-rotary converter assembly assembled in accordance with a fifth example of the invention.

FIG. 8 illustrates a cross-sectional view of a linear-to-rotary converter assembly 600 assembled in accordance with a fifth example of the invention. The linear-to-rotary converter assembly 600 is similar to the linear-to-rotary converter assembly 200 of FIG. 3. Elements of the linear-to-rotary converter assembly 600 which are the same or similar to the linear-to-rotary converter assembly 200 are designated by the same reference numeral. A description of many of these elements is abbreviated or eliminated in the interest of brevity. In contrast to the linear-to-rotary converter assembly 200 of FIG. 3, the linear-to-rotary converter assembly 600 includes a return spring 602 coupled to and between the plunger 207 and the housing 201. Specifically, in the example shown, the return spring 602 is an extension spring coupled to a forward-facing surface 280 of the plunger 207 that forms the step 234 and a rearward-facing surface 282 of the front end cap 214. Using the return spring 602 may be advantageous to reduce the size (e.g., the length) of the linear-to-rotary converter assembly 600 and may, in some examples, allow the linear-to-rotary converter assembly 600 to be used with firearms having a smaller caliber (e.g., a 22 caliber rifle). Thus, the linear-to-rotary converter assembly 600 may allow for a similar and more compact design as compared to the linear-to-rotary converter assembly 200 including the return spring 211 housed within the rod 208. Also, the complexity of the linear-to-rotary converter assembly 600 may be less than the complexity of the linear-to-rotary converter assembly 200. Thus, the ease of manufacturability of the linear-to-rotary converter assembly 600 may be increased as compared to the linear-to-rotary converter assembly 200.

The return spring 602 may be coupled to loops or holes formed in or adjacent the forward-facing surface 280 of the plunger 207 and/or the rearward-facing surface 282 of the front end cap 204. In the example shown, when the plunger 207 moves from the firing position toward the recoil position, the return spring 602 is expanded and urges the plunger 207 back toward the firing position. In the example of FIG. 8, the first rod portion 240 does not include the bore 246 and the return spring 211 is not positioned between the rod 208 and the plunger 207. While this example includes the return spring 602, it will be appreciated that various other springs or other biasing mechanisms may alternatively be used and still fall within the scope of the present disclosure.

Figure 9:
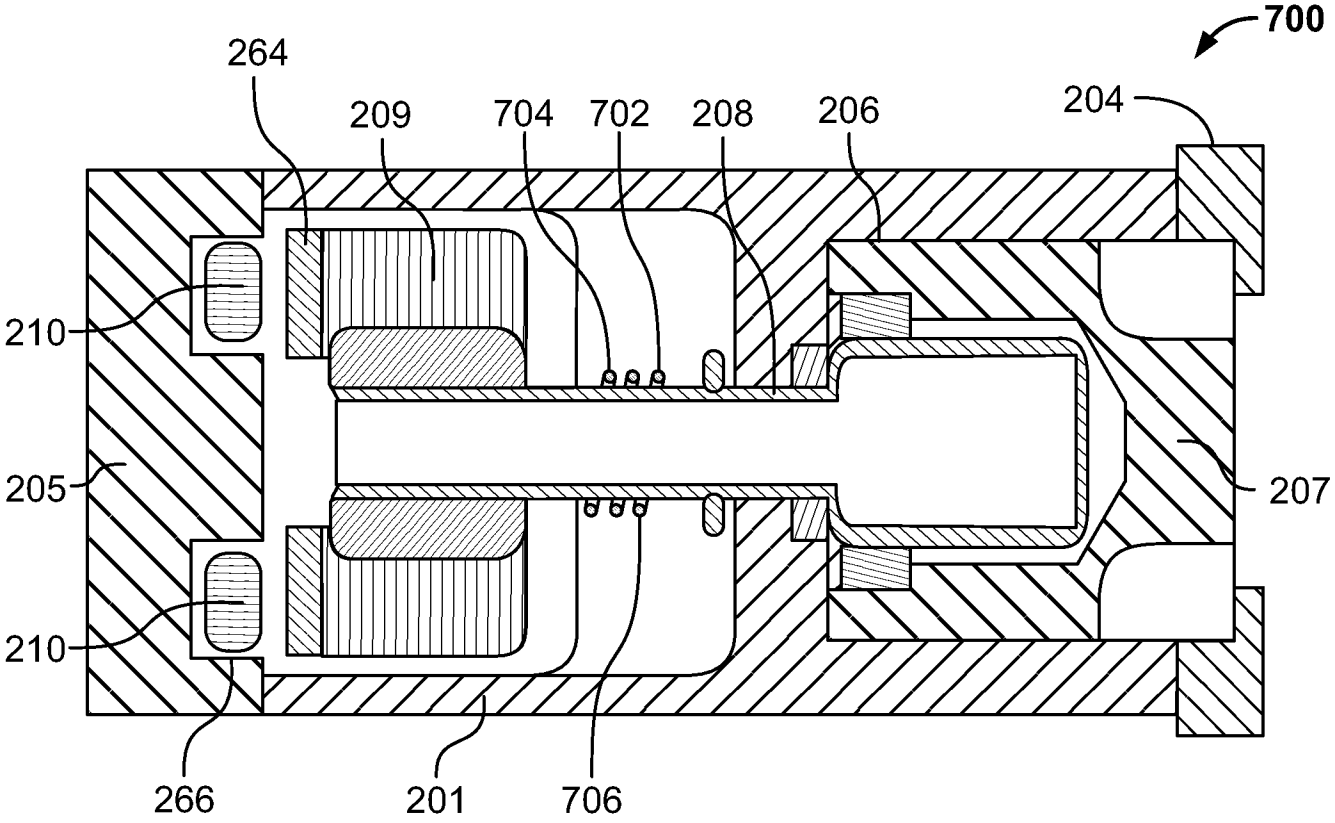
FIG. 9 illustrates a cross-sectional view of a linear-to-rotary converter assembly assembled in accordance with a sixth example of the invention.

FIG. 9 illustrates a cross-sectional view of a linear-to-rotary converter assembly 700 assembled in accordance with a sixth example of the invention. The linear-to-rotary converter assembly 700 is similar to the linear-to-rotary converter assembly 200 of FIG. 2. For example, like the linear-to-rotary converter assembly 200 of FIG. 2, the linear-to-rotary converter assembly 700 also includes the housing 201 having the bore 206 that slidably receives the plunger 207 and the rod 208 that is rotationally coupled within the housing 201 and that threadably engages the plunger 207. The linear-to-rotary converter assembly 500 also includes the one-way bearing 209 through which the rod 208 extends. However, in contrast, the linear-to-rotary converter assembly 700 includes a return spring 702 disposed around the rod 208 and having a first portion 704 and a second portion 706. In this example, the return spring 702 is a torsion spring. Thus, the resistance provided by the return spring 702 is also rotary as compared to the linear resistance provided by the coil spring of the linear-to-rotary converter assembly 200 of FIG. 2. As a result, using the return spring 702 may absorb a greater amount of rotary energy as compared to if the linear coil spring were used.

In the example shown, the first portion 704 of the return spring 702 is coupled to the rod 208 and the second portion 706 of the return spring 702 is coupled to the housing 201. The portions 704, 706 of the return spring 702 may be coupled to loops or holes of the rod 208 and/or the housing 201 or using any other coupling method (e.g., adhesive). Regardless of how the return spring 702 is coupled, the return spring 702 is arranged such that when the rod 208 rotates in the first direction, the return spring 702 is wound in a manner that urges the rod 208 to rotate in the second direction, thereby urging the plunger 207 back toward the firing position. While the return spring 702 is a torsion spring in this example, it will again be appreciated that various other springs and/or other biasing mechanisms may alternatively be used and still fall within the scope of the present disclosure.

Figure 10:
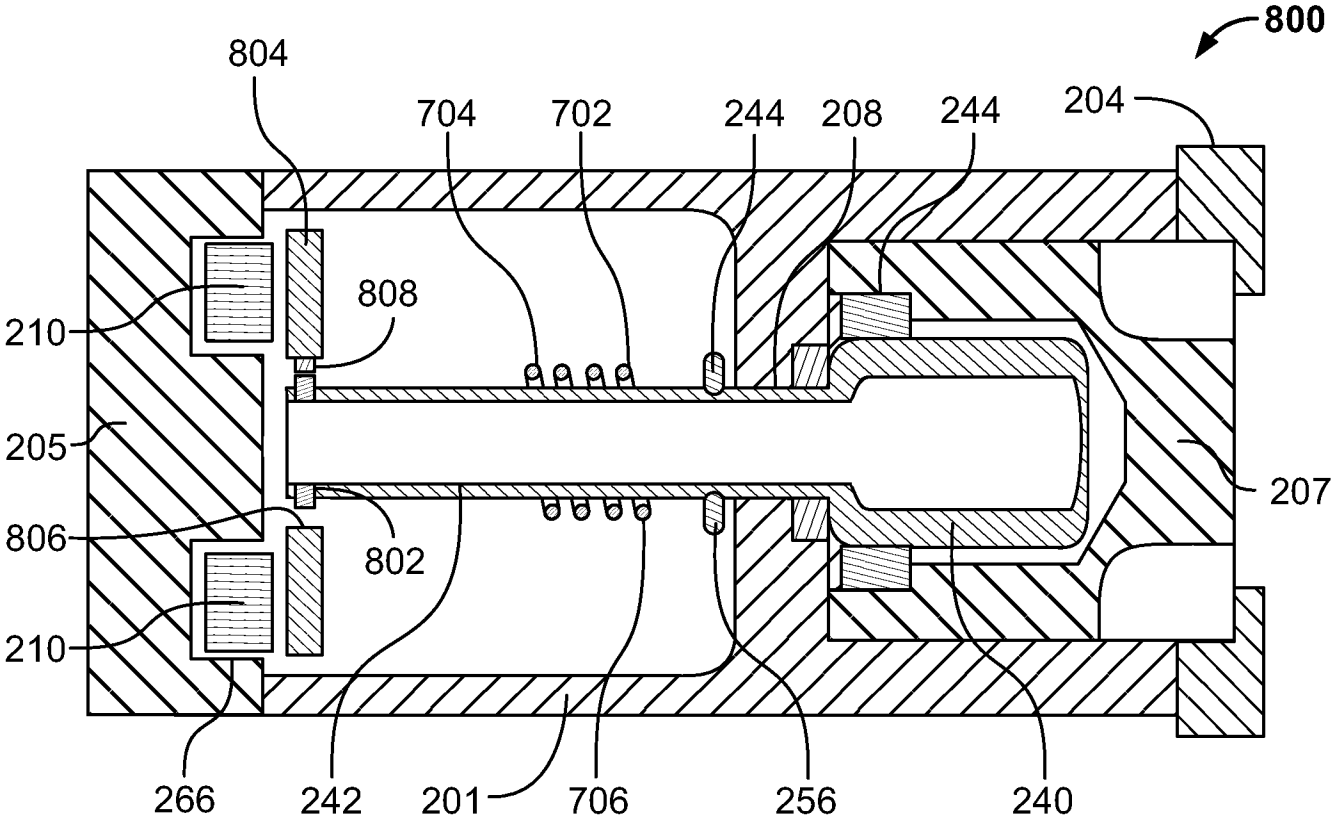
FIG. 10 illustrates a cross-sectional view of a linear-to-rotary converter assembly assembled in accordance with a seventh example of the invention.

Referring now to FIG. 10, a cross-sectional view of a linear-to-rotary converter assembly 800 assembled in accordance with a seventh example of the invention is illustrated. The linear-to-rotary converter assembly 800 is similar to one or more of the linear-to-rotary converter assembly 200 of FIG. 3 or the linear-to-rotary converter assembly 700 of FIG. 9. Elements of the linear-to-rotary converter assembly 800 which are the same or similar to the linear-to-rotary converter assembly 700 are designated by the same reference numeral. A description of many of these elements is abbreviated or eliminated in the interest of brevity. In contrast to the linear-to-rotary converter assembly 700 of FIG. 9, the second rod portion 242 of the rod 208 has teeth 802 that may radially extend from the rod 208. A disk 804 having a bore 806 is disposed within the housing 201 and may be made of ferromagnetic material (e.g., metal).

In the example shown, a follower 808 is coupled to the disk 804 and extends into the bore 806 of the disk 804. The follower 808 is pivotably coupled to the disk 804 and is adapted to engage the teeth 802 in a manner that forms a ratchet. Ratchets such as the one formed between the follower 808 and the teeth 802 may have less tendency to slip when exposed to a threshold amount of torque as compared to if a one-way bearing were used. When the plunger 207 moves from the firing position toward the recoil position and the rod 208 rotates in the first direction, the follower 808 and the teeth 802 of the rod 208 engage in a manner that causes the disk 804 to rotate with the rod 208. Put another way, the follower 808 locks with the teeth 802 to cause the rod 208 and the disk 804 to rotate together when the rod 208 rotates in the first direction.

As the rod 208 and the disk 804 rotate, the plurality of magnets 210 act on the disk 804 slowing rotation of the disk 804 and, thus, the rod 208. When the plunger 207 moves from the recoil position to the firing position and the rod 208 rotates in the second direction, the follower 808 does not lock with the teeth 802 of the rod 208 in a manner that causes the disk 804 to rotate with the rod 208. Thus, when the rod 208 rotates in the second direction, the rod 208 rotates independently from the disk 804 allowing for the rod 208 to rotate without the plurality of magnets 210 resisting or at least minimally resisting rotation of the rod 208. While the above examples disclose a plurality of magnets being used, any number of magnets may be used including one and still fall within the scope of the present disclosure.

Figure 11:
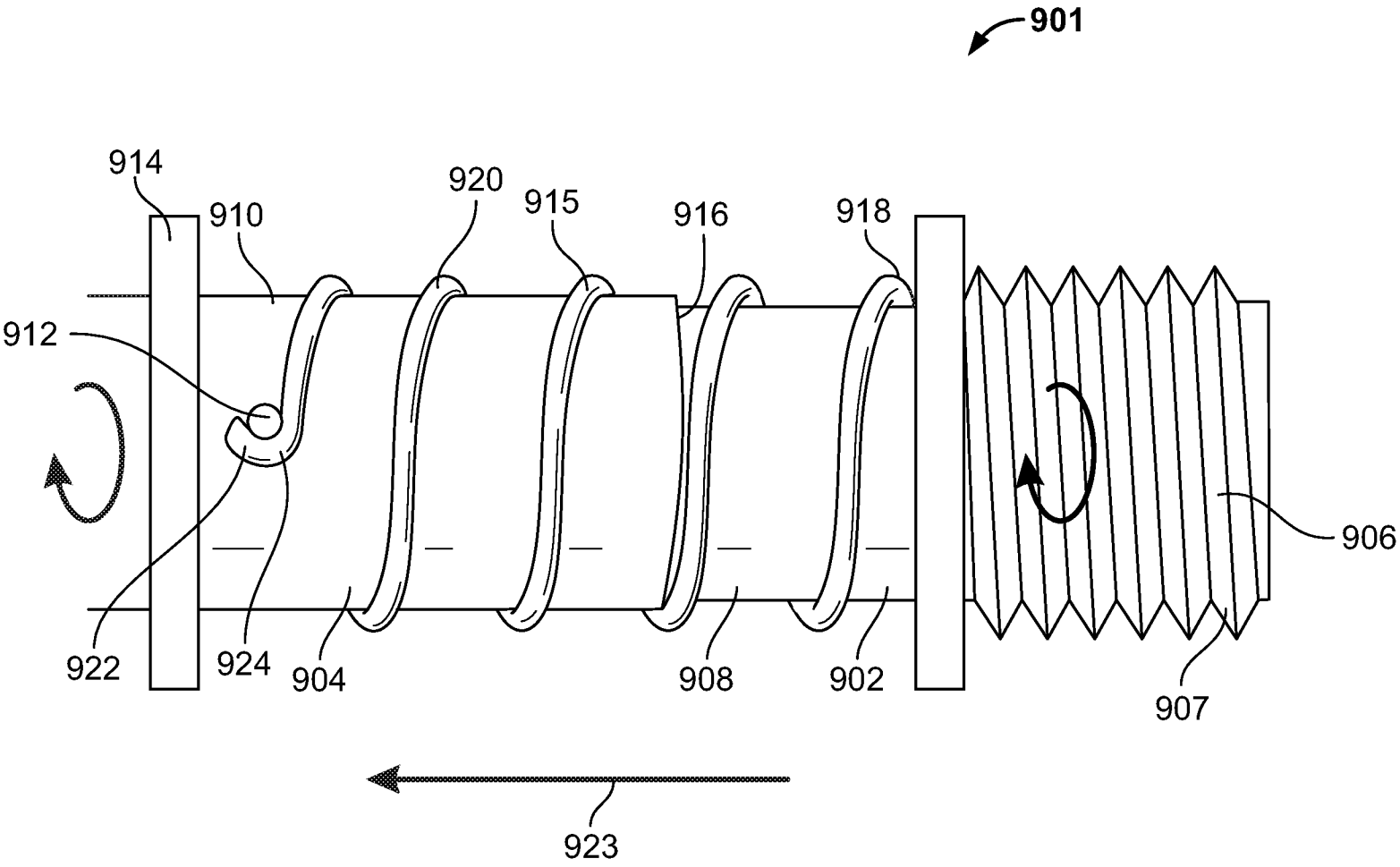
FIG. 11 illustrates a portion a linear-to-rotary converter assembly assembled in accordance with an eighth example of the invention.

FIG. 11 illustrates an alternative portion 901 of a linear-to-rotary converter assembly assembled in accordance with an eighth example of the invention. The portion 901 includes a first rod 902 and a second rod 904. The first rod 902 is adapted to be rotatably coupled within the bore 206 of the housing 201 of FIG. 4. In addition, the first rod 902 includes a first portion 906 having threads 907 and a second portion 908. The threads 907 may be adapted to engage the threads 230 of the plunger bore 228 (FIG. 3). The second rod 904 includes a body 910 from which a lateral protrusion 912 extends and a flange 914. The lateral protrusion 912 may be a pin. The flange 914 may be made of ferromagnetic material or any other material and still fall within the scope of the present disclosure. The body 910 of the second rod 904 defines a bore 916 in which the second portion 908 of the first rod 902 is disposed.

A biasing member 915 surrounds the first rod 902 and the second rod 904 and includes a first portion 918 and a second portion 920. The biasing member 915 is shown as a torsion spring. The first portion 918 of the biasing member 915 is coupled to the first rod 902 and the second portion 920 of the biasing member 915 is selectively coupled to the lateral protrusion 912 of the second rod 904. Specifically, in the example shown, the second portion 920 of the biasing member 915 includes a hook 922. So configured, when the first rod 902 rotates in the first direction as the plunger 207 moves from the firing position to the recoil position in a direction generally indicated by arrow 923, the hook 922 engages the lateral protrusion 912 and causes the second rod 904 to rotate with the first rod 902. As the second rod 904 rotates, the plurality of magnets 210 (not shown in FIG. 11) may act on the flange 914 of the second rod 904 deterring or otherwise slowing rotation of the second rod 904 and, in turn, rotation of the first rod 902. However, when the plunger 207 moves from the recoil position to the firing position in a direction generally opposite that of arrow 923, a curved-rear portion 924 of the hook 922 engages the lateral protrusion 912 in a manner that deflects and/or prevents the hook 922 from coupling with the lateral protrusion 912. As a result, the second rod 904 is not able to rotate with the first rod 902. Thus, when the first rod 902 rotates in the second direction, the first rod 902 rotates independently of the second rod 904 allowing for the first rod 902 to rotate without the plurality of magnets 210 resisting or at least significantly resisting rotation.

Using the biasing member 915 and the linear-to-rotary assembly of FIG. 11 may be advantageous to reduce the size (e.g., the length) of the linear-to-rotary converter assembly 900. In addition, in some examples, this configuration of FIG. 11 may be used with firearms having a smaller caliber (e.g., a 22 caliber rifle) because the hold between the second portion 920 of the biasing member 915 and the lateral protrusion 912 may be less than a threshold value. Thus, the linear-to-rotary converter assembly 900 may allow for a smaller and more compact design as compared to the linear-to-rotary converter assembly 200 including the return spring 211 housed within the rod 208.

Figure 12:
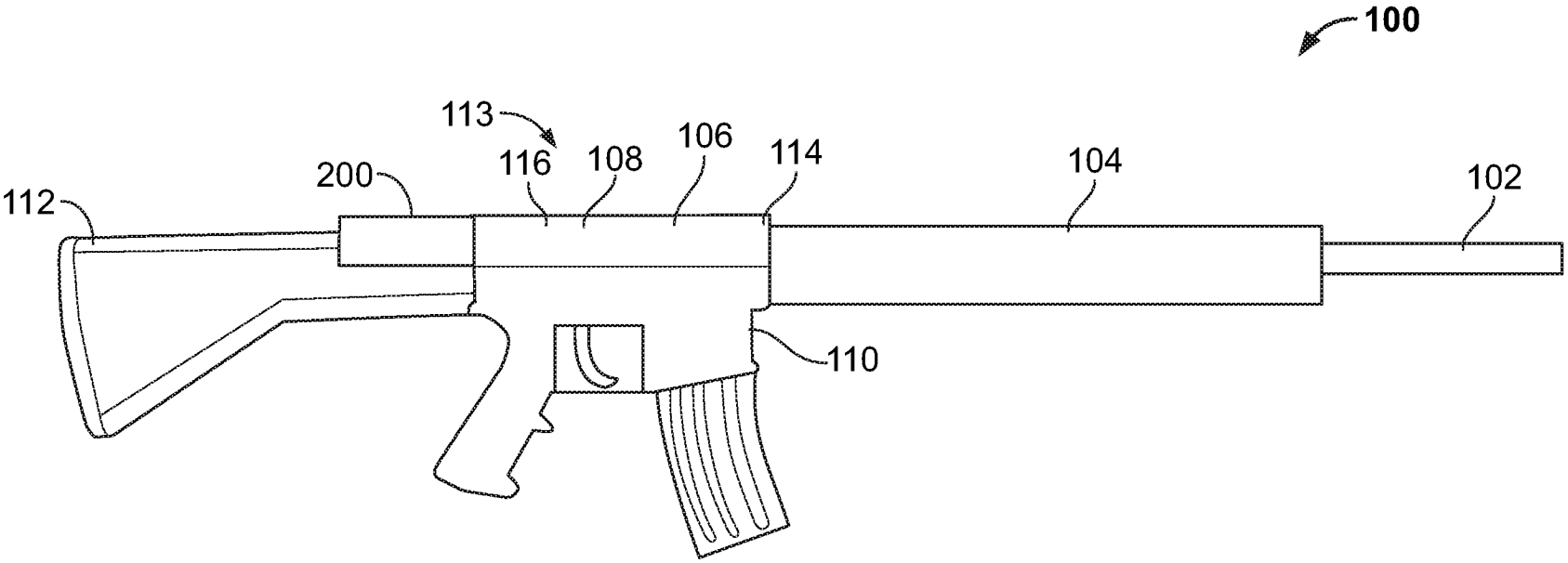
FIG. 12 illustrates another example of the firearm of FIG. 1 including the linear-to-rotary converter assembly coupled to the receiver of the firearm.

FIG. 12 illustrates another example of the firearm 100 of FIG. 1. The firearm 100 of FIG. 12 is similar to the firearm 100 of FIG. 1 in that the firearm 100 of FIG. 12 includes the barrel 102, the handguard 104, the receiver 106, and the bolt assembly 113. As such, a description corresponding to these same parts previously described relative to FIG. 1, for example, is not provided here again for the sake of brevity. However, in contrast to the firearm 100 of FIG. 1, the firearm 100 of FIG. 12 does not include the buffer assembly 118. As a result, the linear-to-rotary converter assembly 200 is directly coupled to the receiver 106 and the bolt assembly 113 may be arranged to impact the plunger boss 226 to move the plunger 207 between the firing position and the recoil position. While the linear-to-rotary converter assembly 200 is shown, any of the foregoing disclosed linear-to-rotary converter assemblies 200, 400, 500, 600, 700, 800 and/or the associated portions 301, 901, may be used with the firearm 100 of FIG. 12 and still fall within the scope of the disclosure.

The linear-to-rotary converter assembly 200 may be coupled to the receiver 106 by one or more fasteners. The fasteners may include a threaded coupling, one or more bolts, or any other fastening mechanism capable of coupling the linear-to-rotary converter assembly 200 to the receiver 106, for example. One or more brackets may be included to allow the plunger boss 226 to be impacted by the bolt assembly 113 and for the linear-to-rotary converter assembly 200 to be attached to the receiver 106. Other arrangements may prove suitable.

From the foregoing, it will be appreciated that the above disclosed apparatus, methods and articles of manufacture are adapted to reduce recoil force in firearms using, for example, magnetic resistance at the rear of the firearm (e.g., at the buffer assembly). Specifically, the linear-to-rotary assemblies are adapted to convert linear motion to rotary motion and to use magnets to slow that rotary motion. As a result, the disclosed examples may reduce a recoil force and/or may reduce the tendency of the end of the barrel of the firearm to move up and to the right when firing the firearm, for example.

While the above discloses the linear-to-rotary assemblies being used with firearms, other uses may prove suitable. For example, linear-to-rotary assemblies may be used with manufacturing machinery, vehicles, or other mechanical devices to convert linear motion to rotary motion while retarding the motion. Put another way, the linear-to-rotary assembles may be used in applications where there may be a desire to reduce an impact of a force (e.g., a shock absorber) or to dampen a force. Some applications may include, but are not limited to, drilling machines, milling machines, and lathes, for example.

Further, while several examples have been disclosed herein, any features from any examples may be combined with or replaced by other features from other examples. Moreover, while several examples have been disclosed herein, changes may be made to the disclosed examples within departing from the scope of the claims.

What is claimed is:

1. A firearm comprising:

a receiver;

a buffer assembly coupled to the receiver, the buffer assembly comprising a buffer tube, a biasing member, and a buffer, the buffer tube having a first portion and a second portion, the first portion of the buffer tube being coupled to the receiver, the biasing member disposed within the buffer tube, the buffer arranged to be biased by the biasing member and to linearly move within the buffer tube between a firing position and a recoil position; and a linear-to-rotary converter assembly comprising a housing, a plunger, a rod, a one-way bearing, and a plurality of magnets, the housing having a first portion, a second portion, and a bore extending between the first and second portions, the first portion of the housing being coupled to the second portion of the buffer tube, the plunger slidably disposed within the bore of the housing, the plunger comprising a plunger body having a plunger bore comprising threads and a plunger boss extending through an opening of the housing, the plunger boss being arranged to be engaged by the buffer when the buffer is in the recoil position, the rod disposed within the bore of the housing and having a first portion and a second portion, the first portion of the rod comprising threads engaging the threads of the plunger bore, the one-way bearing disposed within the bore of the housing and adapted to receive the second portion of the rod, and the plurality of magnets disposed adjacent to the housing, wherein linear movement of the plunger between the firing position and the recoil position rotates the rod and the one-way bearing in a first direction as the plurality of magnets act on the one-way bearing to resist rotation, and linear movement of the plunger between the recoil position and the firing position rotates the rod in a second direction.

2. The firearm of claim 1, wherein the linear movement of the plunger between the recoil position and the firing position rotates the rod in the second direction without the plurality of magnets acting on the rod to resist rotation.

3. The firearm of claim 1, wherein the housing comprises a key extending into the bore of the housing and the plunger body comprises a key seat receiving the key.

4. The firearm of claim 1, wherein the housing comprises a divider having a bore, the divider separating the bore of the housing into a first sub-bore and a second sub-bore, the rod extending through the bore of the divider, the first portion of the rod extending into the first sub-bore, the second portion of the rod extending into the second sub-bore.

5. The firearm of claim 4, wherein one or more of: (1) the first portion of the rod has a larger diameter than the second portion of the rod; or (2) the second portion of the rod comprises an external groove, further comprising a retaining clip disposed in the second sub-bore, received within the external groove of the second portion of the rod, and arranged to abut the divider.

6. The firearm of claim 1, wherein one or more of: (1) the first portion of the rod comprises a bore, further comprising a return spring disposed within the bore of the first portion of the rod and arranged to bias the plunger toward the firing position; or (2) wherein the second portion of the rod comprises a bore and the housing comprises a guide rod that extends through the bore of the second portion of the rod.

7. The firearm of claim 1, wherein the plunger bore comprising threads comprises a ball nut and the rod comprising threads comprises a ball screw.

8. A linear-to-rotary converter assembly movable between a first position and a second position, the linear-to-rotary converter assembly comprising:

a housing having a first portion, a second portion, and a bore extending between the first and second portions;

a plunger slidably disposed within the bore of the housing, the plunger comprising a plunger body and a plunger boss extending from the housing, the plunger body having threads;

a rod disposed within the bore of the housing and having a first portion and a second portion, the first portion of the rod comprising threads engaging the threads of the plunger;

at least one of a one-way bearing or a disk disposed within the bore of the housing, the second portion of the rod extending through the at least one of the one-way bearing or the disk; and at least one magnet disposed within the housing adjacent to the at least one of the one-way bearing or the disk, wherein linear movement of the plunger between the first position and the second position rotates the rod and the at least one of the one-way bearing or the disk in a first direction as the at least one magnet acts on the at least one of the one-way bearing or the disk, and wherein linear movement of the plunger between the second position and the first position rotates the rod in a second direction.

9. The linear-to-rotary converter assembly of claim 8, wherein at least one of 1) the plunger comprises a bore having the threads, and wherein the threads of the first portion of the rod engage the threads of the plunger bore or 2) the plunger comprises external threads and the first portion of the rod comprises a bore having internal threads, the internal threads of the rod engaging the external threads of the plunger.

10. The linear-to-rotary converter assembly of claim 8, wherein the disk is coupled to the one-way bearing and rotates with the one-way bearing in the first direction.

11. The linear-to-rotary converter assembly of claim 10, wherein the at least one magnet is fixed relative to the housing.

12. The linear-to-rotary converter assembly of claim 8, wherein the at least one magnet is fixed to the housing and comprises a first plurality of magnets, and further comprising at least one second magnet, the at least one second magnet being fixed relative to the one-way bearing, the first plurality of magnets act on the at least one second magnet when the rod and the one-way bearing rotate in the first direction.

13. The linear-to-rotary converter assembly of claim 8, wherein the disk is fixed relative to the housing, and the at least one magnet is fixed relative to the one-way bearing and rotates with the one-way bearing in the first direction.

14. The linear-to-rotary converter assembly of claim 8, further comprising a return spring, the return spring adapted to urge the plunger toward the first position.

15. The linear-to-rotary converter assembly of claim 14, wherein the first portion of the rod comprises a bore, and wherein the return spring is disposed within the bore of the first portion of the rod and is adapted to bias the plunger toward the first position.

16. The linear-to-rotary converter assembly of claim 14, wherein the return spring is one of an extension spring coupled to and between the plunger and the housing or a torsion spring disposed around the rod and having a first portion and a second portion, the first portion of the torsion spring coupled to the housing, the second portion of the torsion spring coupled to the rod.

17. The linear-to-rotary converter assembly of claim 8, wherein the disk is disposed within the bore of the housing, the second portion of the rod extending through the bore of the disk, and the second portion of the rod further includes teeth, and a follower is coupled to the disk and extends into the bore of the disk, the follower adapted to engage the teeth to form a ratchet.

18. The linear-to-rotary converter assembly of claim 8, wherein the plunger body having threads comprises a ball nut and the rod comprising threads comprises a ball screw.

19. A firearm, comprising:

a receiver having a bolt assembly, a first portion, and a second portion, the bolt assembly arranged to move between a firing position and a recoil position;

a barrel coupled to the first portion of the receiver;

a buffer tube having a first portion and a second portion, the first portion of the buffer tube being coupled to the second portion of the receiver;

a buffer arranged to engage the bolt assembly, the buffer being further arranged to linearly move within the buffer tube between the firing position and the recoil position; and means for converting the linear movement of the bolt assembly to rotary motion, wherein the means for converting the linear movement of the bolt assembly to rotary motion comprises a linear-to-rotary converter assembly, the linear-to-rotary converter assembly comprising at least one of:

1) a housing coupled to the second portion of the buffer tube and having a bore including an opening; a plunger linearly-movably coupled within the bore of the housing, the plunger comprising a plunger body and a plunger boss, the plunger comprising threads, the plunger boss extending through the opening of the housing and arranged to be engaged by the buffer; a rod rotatably coupled within the bore of the housing, the rod having a first portion and a second portion, the first portion of the rod comprising threads engaging the threads of the plunger, the second portion of the rod comprising teeth; a disk defining a bore and disposed in the housing, the second portion of the rod extending through the bore of the disk, the teeth of the second portion of the rod disposed within the bore of the disk, a follower coupled to the disk and extending into the bore of the disk, the follower adapted to engage the teeth to form a ratchet; and a magnet disposed adjacent the housing, wherein linear movement of the plunger between the firing position and the recoil position rotates the rod and the disk as the magnet acts on the disk;

2) a housing coupled to the second portion of the buffer tube and having a bore including an opening; a plunger movably coupled within the bore of the housing, the plunger comprising a plunger body and a plunger boss, the plunger body comprising threads, the plunger boss extending through the opening of the housing and arranged to be engaged by the buffer; a first rod rotatably coupled within the bore of the housing, the first rod having a first portion and a second portion, the first portion of the first rod comprising threads engaging the threads of the plunger bore; a second rod having a flange and a lateral protrusion and defining a bore, the second portion of the first rod being disposed within the bore of the second rod; a biasing member surrounding the first rod and the second rod, the biasing member having a first portion and a second portion, the first portion of the biasing member coupled to the first rod, the second portion of the biasing member selectively coupled to the lateral protrusion of the second rod; and a magnet disposed adjacent the housing, wherein linear movement of the plunger between the firing position and the recoil position rotates the first rod and the second rod via the selective coupling between the second portion of the biasing member and the lateral protrusion of the second rod as the magnet acts on the flange; or 3) a linear-to-rotary converter assembly.

20. A firearm, comprising:

a receiver having a bolt assembly, a first portion, and a second portion, the bolt assembly arranged to move between a firing position and a recoil position;

a barrel coupled to the first portion of the receiver; and means for converting the linear movement of the bolt assembly to rotary motion, wherein the means for converting the linear movement of the bolt assembly to rotary motion comprises a linear-to-rotary converter assembly, the linear-to-rotary converter assembly comprising at least one of:

1) a housing coupled to the receiver and having a bore including an opening; a plunger linearly-movably coupled within the bore of the housing, the plunger comprising a plunger body and a plunger boss, the plunger comprising threads, the plunger boss extending through the opening of the housing and arranged to be engaged; a rod rotatably coupled within the bore of the housing, the rod having a first portion and a second portion, the first portion of the rod comprising threads engaging the threads of the plunger, the second portion of the rod comprising teeth; a disk defining a bore and disposed in the housing, the second portion of the rod extending through the bore of the disk, the teeth of the second portion of the rod disposed within the bore of the disk, a follower coupled to the disk and extending into the bore of the disk, the follower adapted to engage the teeth to form a ratchet; and a magnet disposed adjacent the housing, wherein linear movement of the plunger between the firing position and the recoil position rotates the rod and the disk as the magnet acts on the disk;

2) a housing coupled to the receiver and having a bore including an opening; a plunger movably coupled within the bore of the housing, the plunger comprising a plunger body and a plunger boss, the plunger body comprising threads, the plunger boss extending through the opening of the housing and arranged to be engaged; a first rod rotatably coupled within the bore of the housing, the first rod having a first portion and a second portion, the first portion of the first rod comprising threads engaging the threads of the plunger bore; a second rod having a flange and a lateral protrusion and defining a bore, the second portion of the first rod being disposed within the bore of the second rod;

a biasing member surrounding the first rod and the second rod, the biasing member having a first portion and a second portion, the first portion of the biasing member coupled to the first rod, the second portion of the biasing member selectively coupled to the lateral protrusion of the second rod; and a magnet disposed adjacent the housing, wherein linear movement of the plunger between the firing position and the recoil position rotates the first rod and the second rod via the selective coupling between the second portion of the biasing member and the lateral protrusion of the second rod as the magnet acts on the flange; or 3) a linear-to-rotary converter assembly.

21. A firearm comprising:

a receiver;

a buffer assembly coupled to the receiver, the buffer assembly comprising a buffer tube, a biasing member, and a buffer, the buffer tube having a first portion and a second portion, the first portion of the buffer tube being coupled to the receiver, the biasing member disposed within the buffer tube, the buffer arranged to be biased by the biasing member and to linearly move within the buffer tube between a firing position and a recoil position; and a linear-to-rotary converter assembly comprising a housing, a plunger, a rod, a one-way bearing, and a plurality of magnets, the housing having a first portion, a second portion, and a bore extending between the first and second portions, the first portion of the housing being coupled to the second portion of the buffer tube, the plunger slidably disposed within the bore of the housing, the plunger comprising a plunger body comprises a ball nut and a plunger boss extending through an opening of the housing, the plunger boss being arranged to be engaged by the buffer when the buffer is in the recoil position, the rod disposed within the bore of the housing and having a first portion and a second portion, the first portion of the rod comprising a ball screw, the one-way bearing disposed within the bore of the housing and adapted to receive the second portion of the rod, and the plurality of magnets disposed adjacent to the housing, wherein linear movement of the plunger between the firing position and the recoil position rotates the rod and the one-way bearing in a first direction as the plurality of magnets act on the one-way bearing to resist rotation, and linear movement of the plunger between the recoil position and the firing position rotates the rod in a second direction.

* * * * *